US010466011B2

(12) United States Patent
Swan et al.

(10) Patent No.: US 10,466,011 B2
(45) Date of Patent: Nov. 5, 2019

(54) WEAPON AND ACCESSORY LINK

(71) Applicant: S&S Precision, LLC, Virginia Beach, VA (US)

(72) Inventors: Johnny E. Swan, Virginia Beach, VA (US); Andrew C. Borland, Virginia Beach, VA (US); William-Joseph Basan Elizalde, Virginia Beach, VA (US); Barrett Dare Locke, Tucson, AZ (US)

(73) Assignee: S&S Precision, LLC, Virginia Beach, VA (US)

( * ) Notice: Subject to any disclaimer, the term of this patent is extended or adjusted under 35 U.S.C. 154(b) by 114 days.

(21) Appl. No.: 15/860,536

(22) Filed: Jan. 2, 2018

(65) Prior Publication Data

US 2018/0188001 A1 Jul. 5, 2018

Related U.S. Application Data

(60) Provisional application No. 62/441,439, filed on Jan. 1, 2017.

(51) Int. Cl.

| | |
|---|---|
| ***F41C 33/04*** | (2006.01) |
| ***A45F 5/02*** | (2006.01) |
| ***F41C 33/00*** | (2006.01) |
| ***F41C 33/02*** | (2006.01) |

(52) U.S. Cl.

CPC ..... *F41C 33/007* (2013.01); *A45F 5/021* (2013.01); *F41C 33/008* (2013.01); *F41C 33/0245* (2013.01); *F41C 33/0263* (2013.01); *A45F 2200/0591* (2013.01); *F41C 33/041* (2013.01)

(58) Field of Classification Search

CPC ..... F41G 11/003; A45F 5/021; A45F 2200/0591; F41C 33/041; F41C 33/04; F41C 33/007; F41C 33/0245

See application file for complete search history.

(56) References Cited

U.S. PATENT DOCUMENTS

| | | | |
|---|---|---|---|
| 1,107,040 | A | 8/1914 | Conde |
| 1,610,092 | A | 12/1926 | Hise |
| 2,236,736 | A | 4/1941 | Scott |
| 2,296,287 | A | 9/1942 | Leyde |
| 2,346,695 | A | 4/1944 | Miller |
| 2,545,419 | A | 3/1951 | Williams |
| 2,837,630 | A | 6/1958 | Shen |
| 2,972,739 | A | 2/1961 | Opper |
| 3,155,297 | A | 11/1964 | Stumpf |

(Continued)

*Primary Examiner* — Justin M Larson

(74) *Attorney, Agent, or Firm* — Tanner IP, PLLC

(57) ABSTRACT

Attachment systems configured to fixedly hold a rail are described, including a first connector integrated with a tactical accessory mount, a base element, including a first engagement portion configured to at least partially wrap around a first edge of the rail, and a movable element configured to move relative to the base and including a second engagement portion configured to at least partially wrap around a second edge of the rail. A locking mechanism is provided to hold the movable element in a closed position with the second engagement portion holding the second edge of the rail and the first engagement portion holding the first edge of the rail. A second connector may be attached to the base element to hold the base element to the tactical accessory mount via the first connector.

20 Claims, 10 Drawing Sheets

(56) References Cited

U.S. PATENT DOCUMENTS 3,348,746 A 10/1967 Stumpf
3,769,663 A 11/1973 Perl
3,834,052 A 9/1974 Steck, III
3,908,950 A 9/1975 Apel
4,008,536 A 2/1977 Adams
4,216,600 A 8/1980 Brueckner et al.
4,504,001 A 3/1985 Nichols
4,750,656 A 6/1988 Bianchi et al.
4,777,754 A 10/1988 Reynolds, Jr.
4,905,396 A 3/1990 Bechtel
4,939,863 A 7/1990 Alexander et al.
5,014,892 A 5/1991 Copeland
5,018,653 A 5/1991 Shoemaker
5,033,219 A 7/1991 Johnson et al.
5,040,322 A 8/1991 Iturrey, Jr.
5,054,170 A 10/1991 Otrusina
5,070,437 A 12/1991 Roberts, Sr.
5,122,781 A 6/1992 Saubolle
5,203,624 A 4/1993 Schier et al.
5,265,781 A 11/1993 Nichols
5,400,008 A 3/1995 Toohey
5,414,405 A 5/1995 Hogg et al.
5,430,967 A 7/1995 Woodman, III et al.
5,436,814 A 7/1995 Hanley
5,438,494 A 8/1995 Harlan
D362,741 S 10/1995 Hollinger
5,469,346 A 11/1995 Haut et al.
5,564,610 A 10/1996 Barron
5,598,958 A 2/1997 Ryan et al.
5,620,120 A 4/1997 Tien
5,622,297 A 4/1997 Rogers et al.
5,633,623 A 5/1997 Campman
5,671,561 A 9/1997 Johnson et al.
5,697,695 A 12/1997 Lin et al.
5,810,221 A 9/1998 Beletsky et al.
5,839,630 A 11/1998 Dunstan et al.
5,850,954 A 12/1998 Dong-Joo
5,865,524 A 2/1999 Campman
6,012,827 A 1/2000 Caplan et al.
6,059,156 A 5/2000 Lehtinen
6,067,013 A 5/2000 Pejic
6,069,557 A 5/2000 Anglin, Jr. et al.
6,112,448 A 9/2000 Gray
6,161,741 A 12/2000 French
6,185,854 B1 2/2001 Solinsky et al.
6,190,018 B1 2/2001 Parsons et al.
6,213,623 B1 4/2001 Campman
6,276,088 B1 8/2001 Matthews et al.
6,371,625 B2 4/2002 Campman
6,393,752 B1 5/2002 Oliver et al.
6,478,441 B2 11/2002 Lam
6,499,245 B1 12/2002 Swan
6,578,311 B2 6/2003 Danielson et al.
6,616,294 B1 9/2003 Henry
6,685,067 B2 2/2004 French
6,742,913 B2 6/2004 Deutsch
6,785,997 B2 9/2004 Oz
6,817,727 B1 11/2004 McFadden
6,922,934 B1 * 8/2005 Huan ..... F41G 11/003 42/127
6,955,279 B1 10/2005 Mudd et al.
6,976,777 B1 12/2005 Herold
7,021,790 B2 4/2006 Parsons
7,077,582 B2 * 7/2006 Johnson ..... F16M 11/041 396/428
7,096,620 B2 8/2006 Zeh
7,156,536 B1 1/2007 McCorkle
7,195,370 B2 3/2007 Riblett et al.
7,218,241 B2 5/2007 Kessel et al.
7,226,183 B2 6/2007 Galli et al.
7,267,453 B2 9/2007 Chang
7,287,873 B2 10/2007 Galli
7,308,772 B1 * 12/2007 Millett ..... F41G 11/003 42/124
7,395,627 B2 7/2008 La France et al.
7,430,828 B2 * 10/2008 Munst ..... F41G 11/003 42/72
7,444,776 B2 11/2008 Adams
7,458,489 B1 12/2008 Mudd et al.
7,517,108 B2 4/2009 Galli et al.
7,523,583 B2 4/2009 Cheng
7,534,006 B2 5/2009 Goswami et al.
7,562,484 B2 7/2009 Kim
7,694,450 B2 4/2010 Keng
7,703,231 B2 * 4/2010 Wei ..... F41G 11/003 42/124
7,735,255 B1 6/2010 Kincaid et al.
7,736,013 B2 6/2010 Griffin
7,743,547 B2 6/2010 Houde-Walter
7,827,724 B1 11/2010 Spinelli
7,836,625 B2 11/2010 Swan et al.
8,166,694 B2 5/2012 Swan
8,276,307 B2 * 10/2012 Deros ..... F41G 11/003 42/127
8,393,105 B1 * 3/2013 Thummel ..... F41G 11/004 42/127
D685,051 S 6/2013 Melville
D695,870 S 12/2013 Melville
8,650,794 B2 * 2/2014 Swan ..... F41C 33/007 42/106
8,752,325 B2 * 6/2014 Ding ..... F41G 11/003 42/90
9,395,158 B2 * 7/2016 Collin ..... F41G 11/003
D771,376 S 11/2016 Ray
9,877,535 B2 * 1/2018 Swan ..... A42B 3/04
10,054,401 B2 * 8/2018 Kolvek ..... F41G 11/003
10,238,201 B2 * 3/2019 Swan ..... A45F 5/00
2002/0096545 A1 7/2002 Chang
2002/0148865 A1 10/2002 French
2003/0090893 A1 5/2003 Nepil
2003/0098323 A1 5/2003 Taylor et al.
2003/0141329 A1 7/2003 Huang
2004/0000083 A1 1/2004 Grant, Jr.
2004/0069821 A1 4/2004 Kobayashi
2006/0026888 A1 2/2006 Cheng
2006/0198132 A1 9/2006 Trigiani et al.
2006/0236583 A1 10/2006 Pikielny
2007/0163163 A1 * 7/2007 Munst ..... F41G 11/003 42/85
2007/0230162 A1 10/2007 Galli et al.
2008/0205037 A1 8/2008 Griffin
2009/0122527 A1 5/2009 Galli
2009/0185854 A1 7/2009 Adams
2009/0190332 A1 7/2009 Sharrah
2010/0018103 A1 1/2010 Holmberg
2010/0128470 A1 5/2010 Swan et al.
2010/0192448 A1 8/2010 Darian
2010/0276464 A1 * 11/2010 Hirt ..... F41C 33/0245 224/243
2011/4003269 2/2011 Swan
2011/0167703 A1 * 7/2011 Deros ..... F41G 11/003 42/90
2012/0180363 A1 * 7/2012 Frascati ..... F41G 11/003 42/90
2015/0157118 A1 * 6/2015 Tseng ..... A45F 5/02 403/322.4
2015/0327658 A1 11/2015 Swan et al.

* cited by examiner

WEAPON AND ACCESSORY LINK

RELATED APPLICATIONS

This application claims priority to U.S. Provisional Application No. 62/441,439 filed Jan. 1, 2017 and entitled "WEAPON AND ACCESSORY LINK," the contents of which are hereby incorporated herein by reference.

BACKGROUND

Embodiments generally relate to the attachment of accessories to military and law enforcement tactical equipment, belts, vehicles, or other objects, surfaces, or materials. More particularly, some embodiments relate to the attachment or optional mounting of firearms or assault rifles onto tactical equipment, belts, vehicles, or other objects.

The current popular method for attachment of an assault rifle onto tactical equipment is the use of nylon webbing as a sling. The sling is configured in such a manner that it creates a loop of webbing from the rifle at one point, around the individual and back to the rifle at the same point or other point depending on individual preference.

As the sling is a simple loop of material around the individual, it provides no real retention of the rifle during other activities that require the rifle to be out of the way and secure. When the weight of the rifle is solely loaded on the sling without the individual touching the rifle, the rifle is referred to as 'slung'. When the rifle is slung to the front position, side position, or the back of the body, it is not held in position by anything other than gravity tension on the sling and the lack of movement by the individual. If the individual were to climb, walk, run, bend over, or fall down, the rifle would move out of its intended position. Therefore, there exists a need to facilitate a convenient and secure attachment and detachment method of the rifle or other firearm and/or one or more accessories to tactical equipment, belts, vehicles, or other objects.

U.S. Pat. No. 8,166,694, entitled "FIREARM SECURING DEVICE AND METHOD," the entire contents of which are hereby incorporated by reference, describes related systems to that of the present application.

U.S. Patent Publication No. 2015/0327658 entitled "GEAR TRACK SYSTEM," the entire contents of which are hereby incorporated by reference, describes systems for securing tactical accessories to an individual.

SUMMARY

This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter.

The present subject matter includes and relates to apparatus that provide for secure, convenient, fast, and easy attachment and/or detachment of a firearm, tool, and/or accessory to/from tactical equipment, objects, surfaces, or materials. Embodiments may further include the option of one-handed attachment and/or detachment of the firearm, tool, and/or accessory to/from tactical equipment, objects, surfaces, or materials, or vice versa.

Embodiments may advantageously provide attachment with positional security and modularity by allowing a user to specify and/or change the location that a weapon or other item is secured to their person, and/or to quickly change out the type(s) of holder connected to their gear.

Embodiments may include an apparatus for connecting a rail system (such as may be secured to a firearm for mounting accessories thereto) to tactical equipment or a material or object. According to first aspects of the disclosure, an attachment system, configured to fixedly hold a rail, may include one or more of a first connector integrated with a tactical accessory mount; a base element, including a first engagement portion configured to at least partially wrap around a first edge of the rail; a movable element configured to move relative to the base and including a second engagement portion configured to at least partially wrap around a second edge of the rail; a locking mechanism configured to hold the movable element in a closed position with the second engagement portion holding the second edge of the rail and the first engagement portion holding the first edge of the rail; and/or a second connector attached to the base element and configured to hold the base element to the tactical accessory mount via the first connector.

In embodiments, the locking mechanism may be further configured to transition from an open position to the closed position via pressure applied by the rail toward the base element.

In some embodiments, pressure applied by the rail toward the base element may cause, for example, a tooth to slide into a position that locks the attachment system to the rail once the rail is seated in place.

In some embodiments, the rail may be at least one of a MIL-STD-1913 rail.

In some embodiments, the rail may be fixedly attached to a firearm, whereby the attachment system secures the firearm to the tactical accessory mount.

In some embodiments, the first and second connectors are configured to engage with one another via a quick release, such as a male and female connectors with a finger actuated detent, a spring fitting, a spear fitting with a compressible release, etc.

In some embodiments, at least part of the moveable element moves in a first direction toward the first engagement portion when transitioning between the open position to the closed position.

In some embodiments, the locking mechanism may be further configured to release the rail from the attachment apparatus via finger pressure applied substantially opposite to the first direction.

In some embodiments, the tactical accessory mount may be at least one of a belt mount or a panel including a plurality of the first connectors.

In some embodiments, the first connector and the second connector are attachable to one another using a male member of the second connector and a female member of the first connector, the male member and the second connector acting together as one monolithic unit when attaching the first connector to the second connector, the female member including a slot in the first connector, the male member insertable in and moveable in the slot to attach the first connector and the second connector to one another.

In some embodiments, the first connector includes a flexible tooth that holds the male member in the slot, and releases the male member from the first connector via finger pressure that displaces the flexible tooth.

According to further aspects of the disclosure, an attachment system, configured to fixedly hold a rail, may include one or more of a base element, including a first engagement portion configured to at least partially wrap around a first edge of the rail; a movable element configured to move relative to the base and including a second engagement portion configured to at least partially wrap around a second edge of the rail; a locking mechanism configured to hold the movable element in a closed position with the second engagement portion holding the second edge of the rail and the first engagement portion holding the first edge of the rail; and/or a mount connector attached to the base element and configured to hold the base element to a tactical accessory mount.

In some embodiments, the locking mechanism may be further configured to transition from an open position to the closed position via pressure applied by the rail toward the base element, at least part of the moveable element moves in a first direction toward the first engagement portion when transitioning between the open position to the closed position, and/or the locking mechanism may be further configured to release the rail from the attachment apparatus via finger pressure applied substantially opposite to the first direction.

In some embodiments, the rail may be at least one of a MIL-STD-1913 rail.

In some embodiments, the rail may be fixedly attached to a firearm, whereby the attachment system secures the firearm to the tactical accessory mount.

In some embodiments, the mount connector may be configured to engage with the tactical accessory mount via a quick release.

In some embodiments, the tactical accessory mount may be at least one of a belt mount or a panel including a plurality of the first connectors.

Embodiments may include a first connector integrated with a tactical accessory mount.

In some embodiments, the first connector and the second connector are attachable to one another using a male member of the second connector and a female member of the first connector, the male member and the second connector acting together as one monolithic unit when attaching the first connector to the second connector, the female member including a slot in the first connector, the male member insertable in and moveable in the slot to attach the first connector and the second connector to one another.

In some embodiments, the first connector includes a flexible tooth that holds the male member in the slot, and releases the male member from the first connector via finger pressure that displaces the flexible tooth.

According to further aspects of the disclosure, an attachment system configured to fixedly hold a rail may include one or more of a base element, including a first engagement portion configured to at least partially wrap around a first edge of the rail; a movable element configured to move relative to the base and including a second engagement portion configured to at least partially wrap around a second edge of the rail; a locking mechanism configured to hold the movable element in a locked position with the second engagement portion holding the second edge of the rail and the first engagement portion holding the first edge of the rail; and/or a release mechanism including a first pressure receiving portion that releases the locking mechanism and a second pressure receiving portion that moves the movable element to an open position in which the rail can be released from the attachment system.

In embodiments, the locking mechanism may be further configured to transition to the locked position via pressure applied by the rail toward the base element.

In embodiments, the first pressure receiving portion and the second pressure receiving portion may be configured to operate via a finger pressure applied in a single direction.

In embodiments, the locking mechanism may include at least one locking pin that causes the locking mechanism to lock, and/or causes the first pressure receiving portion to move to an operating position, based on contact with the rail as the rail is seated in the attachment system.

Other embodiments may include a method of connecting a firearm, preferably having a rail system, to tactical equipment, comprising providing an apparatus as described herein, and attaching the rail of the firearm to the apparatus.

These and other aspects of the invention will now become apparent to those of ordinary skill in the art upon review of the following description of embodiments of the invention in conjunction with the accompanying drawings.

BRIEF DESCRIPTION OF THE DRAWINGS

So that the manner in which the above-recited features of embodiments can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
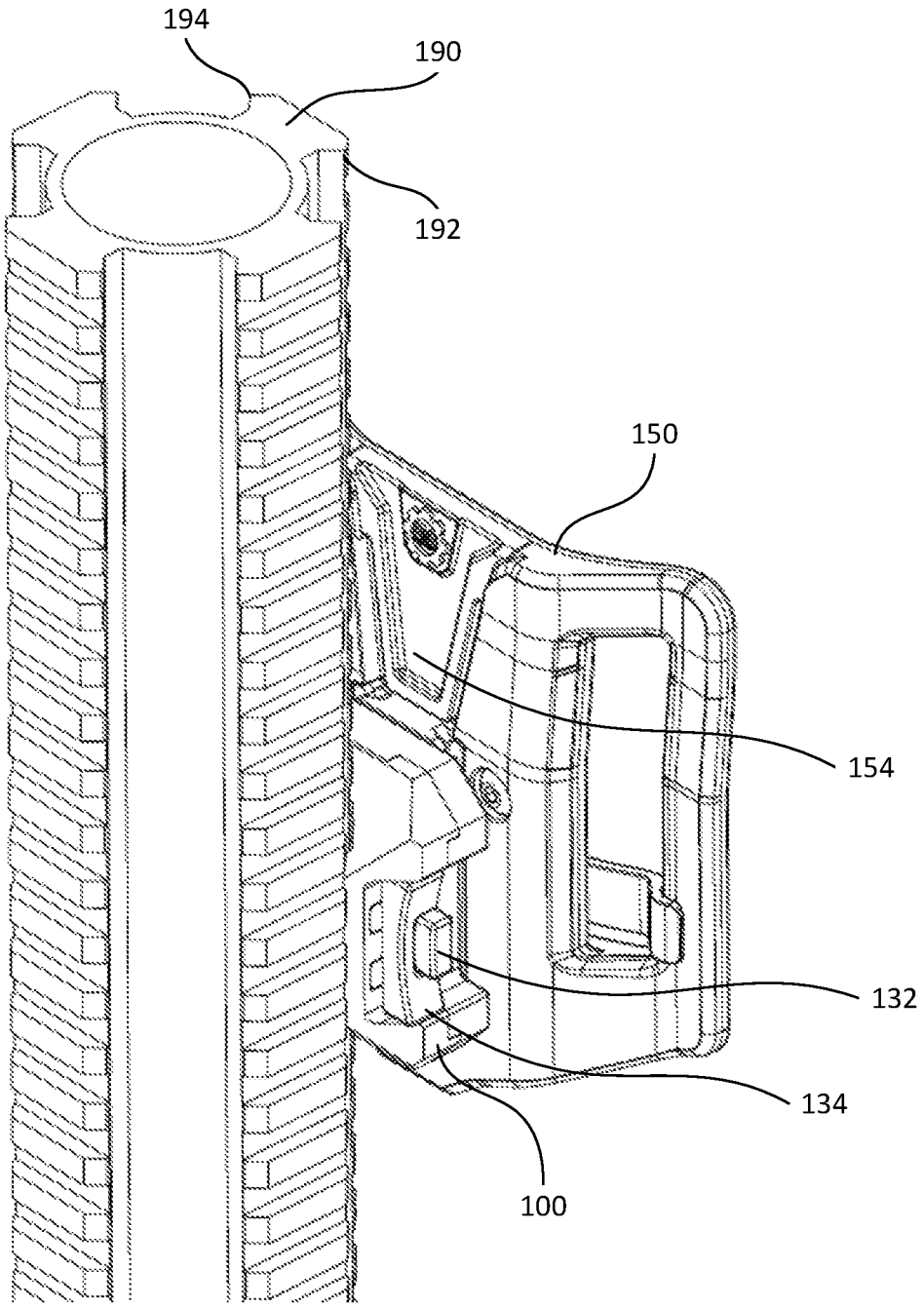
FIG. 1 is a side perspective view of a first embodiment of an exemplary attachment apparatus operatively attached to a rail system.

It is to be expressly understood that the description and drawings are only for the purpose of illustrating certain embodiments of the invention and are an aid for understanding. They are not intended to be a definition of the limits of the invention.

DETAILED DESCRIPTION

It is understood that the invention is not limited to the particular methodology, protocols, etc., described herein, as these may vary as the skilled artisan will recognize. It is also to be understood that the terminology used herein is used for the purpose of describing particular embodiments only, and is not intended to limit the scope of the invention. It also is to be noted that as used herein and in the appended claims, the singular forms "a," "an," and "the" include the plural reference unless the context clearly dictates otherwise. Thus, for example, a reference to "a rail" is a reference to one or more rails and equivalents thereof known to those skilled in the art.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

Embodiments may include a platform herein referred to as an attachment system, or similar nomenclature. Embodiments may generally include a tactical gear mount or platform, a base element or other intermediary element that is releasable connected to the tactical gear mount and configured to hold a tactical rail (or other fixed portion) of a weapon or tactical equipment. The apparatus may include slides, threaded holes, spindles, clips, spring loaded tension devices, and/or other mounting fixtures suitable for securing the one or more accessories to various surfaces or tactical equipment, some examples of which are described herein.

Advantageously, exemplary apparatus may permit the user to attach and/or detach a weapon to and/or from tactical equipment (other surface) using only one hand with positional security resulting upon attachment. Embodiments advantageously allow use of the apparatus with already-manufactured rail systems, tactical equipment, and optional accessories. In some examples, this may all be done without tools, including attachment and removal of the intermediary element to the tactical gear mount, and attachment and removal of the weapon to the intermediary element.

A first embodiment is shown in FIG. 1. Depicted in FIG. 1 is a rail-equipped handguard, having four rail sections 190, one of which is removably attached to a rail retention device 100, which, in turn, is removably attached to a tactical gear mount (in this case a belt mount 150). The rail sections 190 may have ridges or raised portions with spaced slots or cutouts therebetween. In one embodiment, the rail section may be a M1913A Picatinny rail section, although the rail section may instead be any type of rail section known to those skilled in the art. The rail section may be attached to a firearm (such as an assault rifle handguard), or other tactical accessory or accessory holder, or may be integrally formed with such items (such as machined on the upper receiver of a rifle or submachinegun, etc.). The rail section or rail may be a bracket connectable to a firearm or other item for providing a standardized platform for mounting accessories thereto. For purposes of discussion, the rail section 190 may be described as having opposing rail edges 192, 194, which may also be referred to as a first rail edge and a second rail edge.

The rail retention device 100 is attached to the belt mount 150 via cooperating track fittings (described further herein) and secured in the track fitting via release mechanism 154, which in this case is in the form of a deflecting tooth that is displaced as the connector of the rail retention device 100 is inserted in the cooperating connector of the belt mount 150, and that substantially returns to its original position to hold the top of the connector of the rail retention device 100 seated in the cooperating connector of the belt mount 150.

The rail retention device 100 also includes a first actuator 132 (or pressure receiving portion), responsive to finger pressure of a user to unlock the rail retention device 100, and a second actuator (or pressure receiving portion) responsive to finger pressure of the user to open the rail retention device 100.

Figure 2:
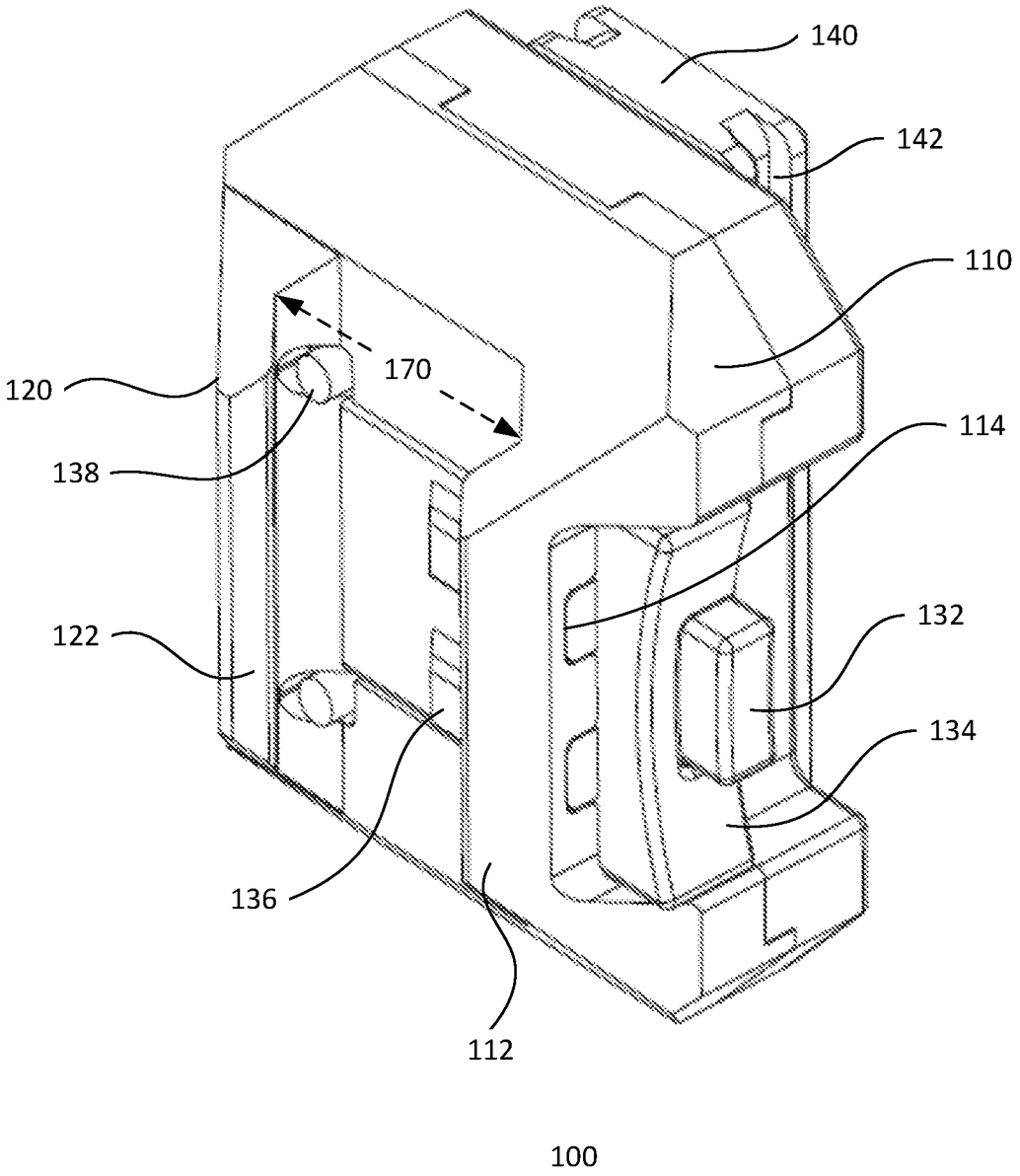
FIG. 2 is a front perspective view of an exemplary attachment mechanism detached from the rail system shown in FIG. 1.
Figure 3:
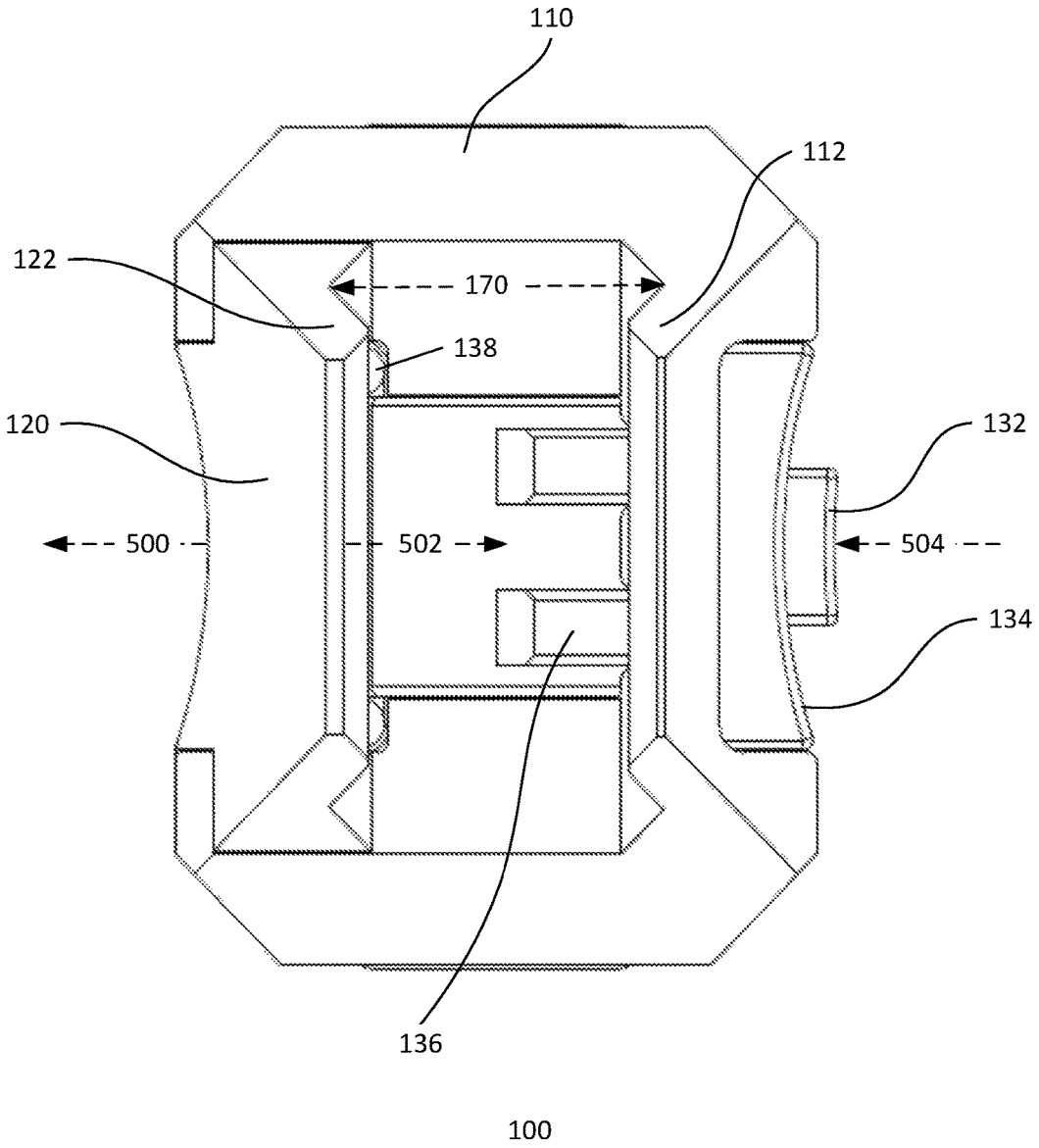
FIG. 3 is a top-down view of an exemplary attachment mechanism detached from the rail system shown in FIG. 1.

The rail retention device 100 shown in FIG. 1 is clamped to sides of the rail section 190 by means of a moveable element 120, shown in greater detail in FIG. 2. As can be seen in FIGS. 2 and 3, the clamping portions seen on the facing portion of the rail retention device 100 are configured to fixedly hold the rail in a channel 170, and include a first engagement portion 112 (which may be fixed to a base element 110) and a second engagement portion 122, which may be formed by or with a moveable portion 120 that slides laterally in direction 500 in order to open, and in direction 502 to close around the rail section 190 (shown in FIG. 1). Thus, the embodiment shown in FIGS. 1-3 includes an exemplary first engagement portion 112 configured to at least partially wrap around a first edge 192 of the rail and a movable element 120 configured to move relative to the base 110 and including a second engagement portion 122 configured to at least partially wrap around a second edge 194 of the rail.

The base 110 may also include a locking mechanism configured to hold the movable element 120 in a closed position with the second engagement portion 122 holding the second rail edge 194 and the first engagement portion 112 holding the first rail edge 192. The locking mechanism can take many forms, any one of which may, for example, releasably secure the weapon to the base element.

In embodiments, the locking mechanism may include a spring-loaded locking pin 138 that protrudes from the base 110 (as shown in FIG. 2), and that is pushed into the base 110 as the rail is seated in the rail retention device 100. The movement of the locking pin into the base 110 may mechanically actuate a physical lock that prevents the moveable element 120 from moving in the direction 500. In some embodiments, the motion of the locking pin into the base 110 may cause the first actuator 132 to be released to an extended position (such as shown in FIG. 2), or otherwise enabled, whereby the first actuator 132 may then be used as a release button (e.g. by a user applying finger pressure in direction 504) to unlock the locking mechanism and allow the moveable element 120 to move in the direction 500. The second actuator 134 (which in some examples may be fixed to the moveable element 120) may then cause the moveable element 120 to move in the direction 500 (i.e. to "open") based on a continued finger pressure in direction 504.

The rail retention device 100 may include one or more positioning rail(s) 136 in the bed of channel 170 that are sized and spaced to fit between the individual rails of the rail section 190, thus further securing the rail section 190 in the rail retention device 100, and substantially preventing the rail section 190 from sliding up or down (as viewed in FIG. 1). In some examples, the positioning rail(s) 136 may be fixed to the moveable element 120, and may engage with the base 110 via positioning rail slot(s) 114.

The rail retention device 100 may further include a connector 140 for attaching the rail retention device to a tactical accessory mount or other complimentary attachment. In the embodiment shown in FIG. 2, the connector 140 includes a groove 142 whereby the connector 140 can be slid into a corresponding channel, such as described further herein. The connector 140 also includes a substantially flat top surface whereby a mechanical release mechanism can be positioned in a flush position that securely retains the connector 140 while allowing for a smooth release.

FIGS. 4A-4C, 5A and 5B provide additional details of exemplary ways that the rail retention device 100 may be operatively engaged with a rail section 190. For example, as shown in FIGS. 4A-4C, 5A and 5B, the rail retention device 100 may be variously configured to transition from an open position to a closed and/or locked position via pressure applied by the rail toward the base element. Unless otherwise specified, an "open" configuration generally refers to a configuration in which the rail retention device is able to receive a rail section, whereas a "held open" configuration is more specifically one in which the moveable element 120 is temporarily held in an extended position whereby the rail section can be secured in the rail retention device without the rail section applying force directly to the moveable element 120.

As described further below, some embodiments may be configured to return the moveable element 120 to its original position (shown in FIG. 2) after opening, such as by spring loading the moveable element 120 in direction 502. The locking pins 138 may be released via the opening pressure on first actuator 132 and again protrude from the base 110. In this configuration, the moveable element 120 is able to move in either of directions 500 and 502, and can again receive a rail section.

Figure 5A:
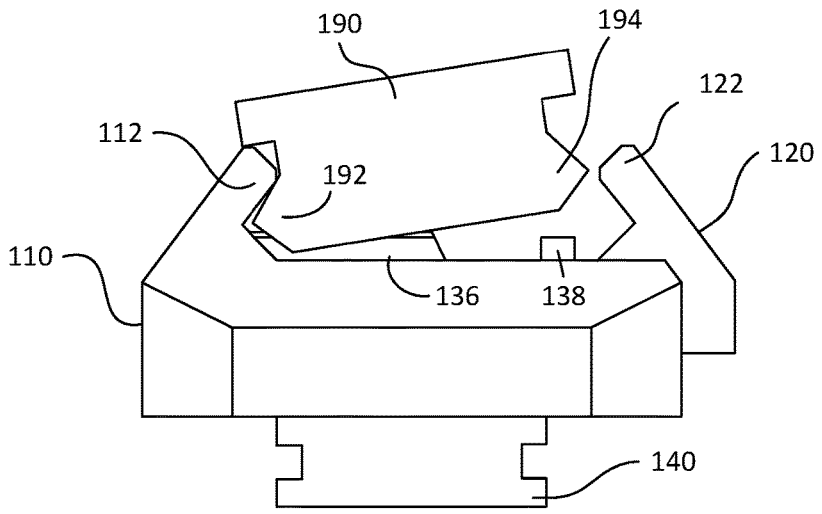
FIGS. 5A and 5B show additional aspects of an exemplary attachment apparatus engaging with a rail system.

Some embodiments may be configured to hold the moveable element 120 in an open position (e.g. as shown in FIG. 5A) after opening. In this case, the locking pins 138 may also be released via the opening pressure on first actuator 132 and again protrude from the base 110 while the moveable element 120 is held in the open position. In this configuration, the moveable element 120 is restrained from moving in either of directions 500 and 502, but can receive a rail section (without forcing the moveable element 120 open). In some examples, the mode of auto-closing and/or holding open may be set by a user, such as by a mechanical switch (not shown) that engages and/or disengages the hold-open feature.

Figure 4A:
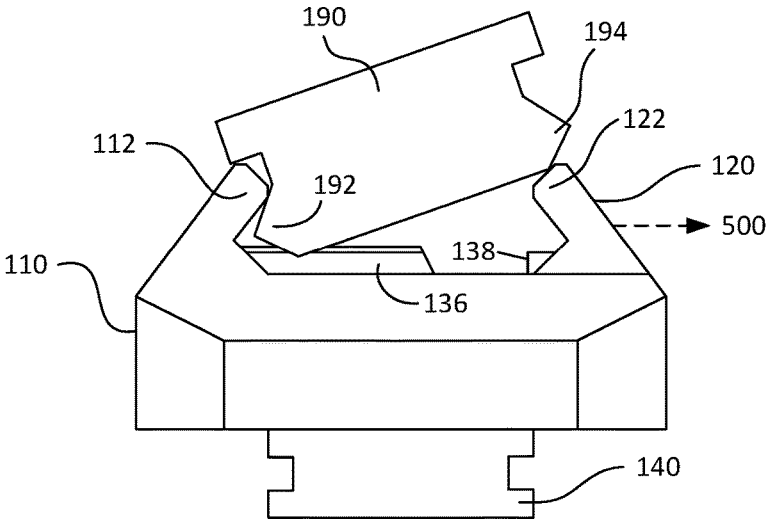
FIGS. 4A-4C show aspects of the exemplary attachment apparatus engaging with a rail system.
Figure 4B:
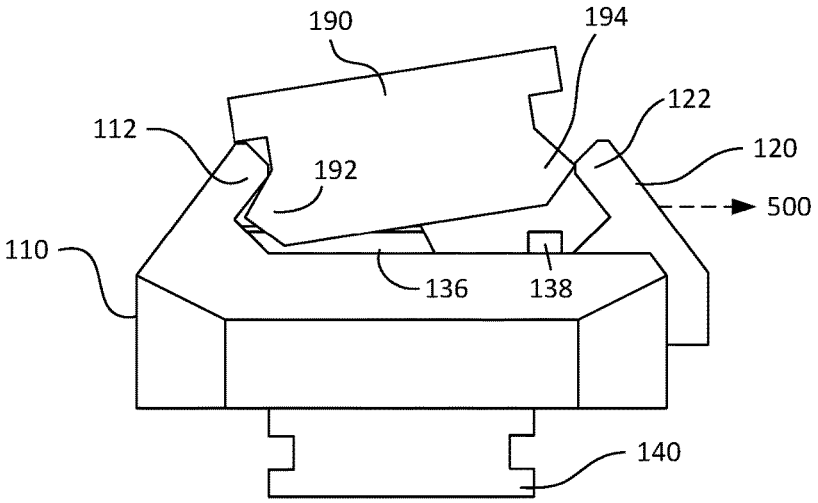
Figure 4C:
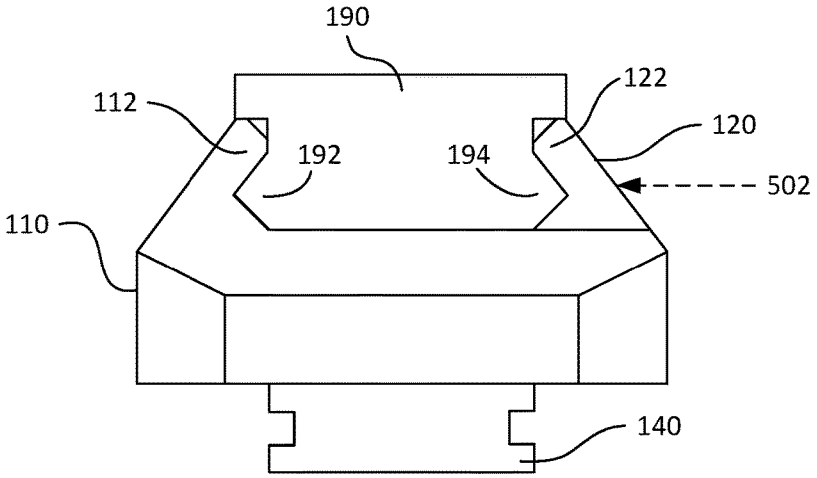

As shown in FIGS. 4A-4C, the movable element 120 may be configured to open, and to transition back to a closed and/or locked position, via pressure applied by the rail toward the base element. That is, a user applies pressure to the rail section forcing it into the channel 170 (which may be understood as downward in FIGS. 4A-4C, 5A and 5B). This may be done by "rolling" the rail section into the channel via a first rail edge 192 that engages with the engagement portion 112 of the base 110, and then applying downward pressure via the second rail edge 194 against the engagement portion 122 of the moveable element 120. As shown in FIG. 4A, this downward force is translated to a lateral force by the sloped edge of engagement portion 122, and causes the moveable element 120 to move in direction 500 until the second rail edge 194 can clear the engagement portion 122, as shown in FIG. 4B.

As the rail section 190 is seated in the channel 170, the moveable element 120 moves back in direction 502, and the locking pin 138 is pressed into the base 100. The rail section is then secured in the channel as shown in FIG. 4C, which may be a locked position by virtue of, for example, mechanical engagement of an internal blocking element (not shown), or other means. As mentioned above, the movement of the locking pin(s) 138 may also push and/or release the first actuator 132 into an operable position, whereby the first actuator 132 can unlock the locking mechanism, e.g. via reversing a mechanical effect of the locking pin(s) 138 or other internal apparatus.

Thus, in some examples, the rail retention device 100 may be opened and closed simply by pressing the rail section 190 into the rail retention device 100, or "rolling" it into the rail retention device 100, e.g. by engaging the rail section 190 with the fixed (first) engagement portion 112 of the base 110 followed by a rolling pressure into the rail retention device 100 that opens and closes the moveable portion 120.

Figure 5B:
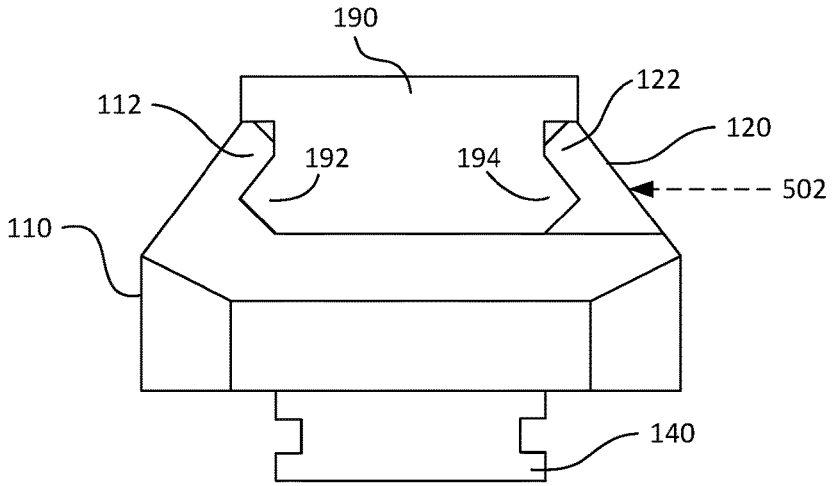

As shown in FIG. 5A, in some embodiments, the movable element 120 may be configured to be "held open," e.g. when the moveable element is released and extended via the first and second actuators 132, 134. In this instance, the rail is allowed to enter between the engagement portions 112, 122 without exerting pressure on the moveable portion 120. A user simply applies pressure sufficient to press in the locking pins 138, which allows the moveable portion to close in direction 502, as shown in FIG. 5B, which may be a locked position by virtue of, for example, mechanical engagement of a blocking element (not shown) with the moveable element, or other means. As mentioned above, the movement of the locking pin(s) 138 may also push and/or release the first actuator 132 into an operable position, whereby the first actuator 132 can unlock the locking mechanism, e.g. via reversing a mechanical effect of the locking pin(s) 138.

Thus, in some examples, the rail retention device 100 may be opened and closed simply by pressing the rail section 190 into the rail retention device 100, or "rolling" it into the rail retention device 100, e.g. by engaging the rail section 190 with the fixed (first) engagement portion 112 of the base 110 followed by a rolling pressure into the rail retention device 100 that opens and closes the moveable portion 120.

In some examples, the moveable element 120 may be biased toward the open position, and pressure on the locking pins 138, or other element, may be used to overcome that bias and close the rail retention device 100. Such examples may be beneficial, for example, in making it easier for a user to remove a weapon or tool from the rail retention device 100.

In some embodiments, the locking mechanism may be further configured to release the rail from the attachment apparatus via finger pressure, e.g. applied substantially opposite to the closing direction of the moveable element. For example, as shown in FIGS. 1-3, the base 110 may include a first actuator 132 that is responsive to a user's finger pressure to release the moveable element 120, and/or second actuator 134 to move the moveable element 120, and free the weapon rail from the engagement portions.

Figure 6A:
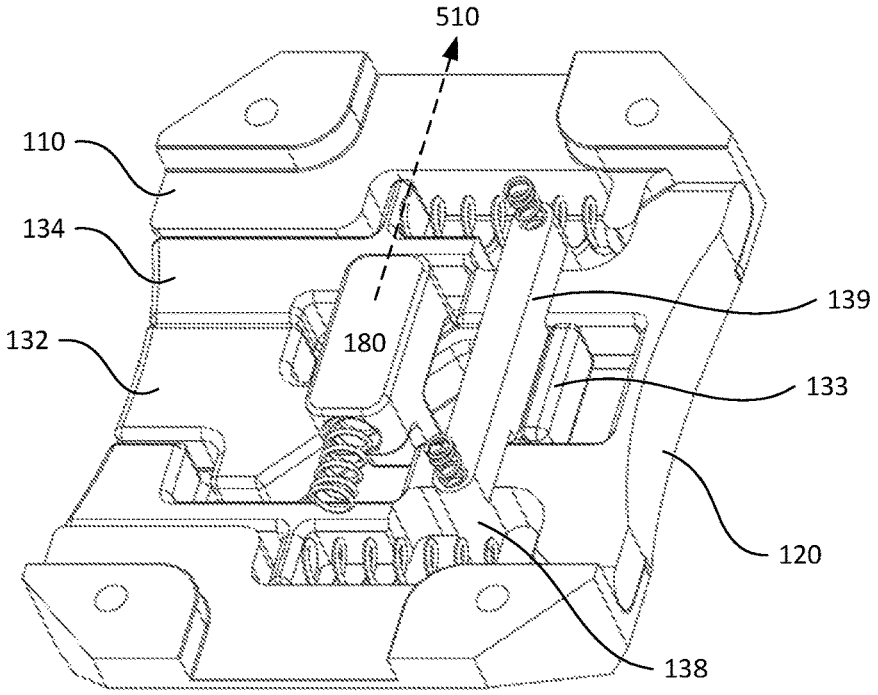
FIGS. 6A-6D show additional aspects of an exemplary internal mechanism for an attachment apparatus according to aspects of the invention.

Additional details of exemplary internal locking and release mechanisms are shown in FIGS. 6A-6D. FIG. 6A depicts a configuration in which the rail retention device 100 is closed, but unlocked and ready to receive a rail. As shown in FIG. 6A, base 110 may include first actuator 132 and second actuator 134, which are capable of sliding, at least partially, relative to one another. A portion of the first actuator 132 runs through a blocking element 180, which is spring biased in the direction 510. First actuator 132 is also connected to a retaining part 133 that is engaged with a blocking bar 139. Blocking bar 139 is connected to locking pins 138 and is spring biased toward engagement with the retaining part 133, and to extend the locking pins 138 from the base (as shown in FIGS. 2 and 4B). In this configuration, the moveable element 120 is capable of extending, as shown in FIG. 4B, but is spring biased to a flush rest position. However, other configurations, such as with an "open bias," are also contemplated.

Figure 6B:
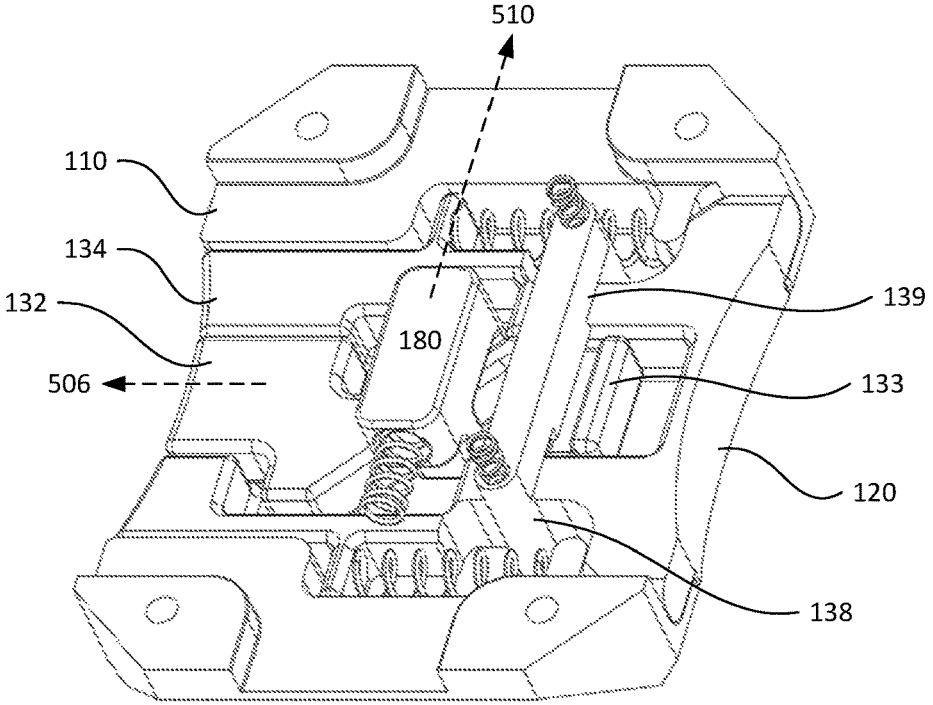

FIG. 6B depicts a configuration in which the locking pins 138 have been pressed into the base 110, moving the blocking bar 139 out of engagement with retaining part 133. This allows a movement of the first actuator 132 in direction 506, which is urged by the pressure of blocking element 180 on an angled portion of the first actuator 132 running through the blocking element 180. The release of the retaining part 133 also allows movement of the blocking element 180, as discussed below.

Figure 6C:
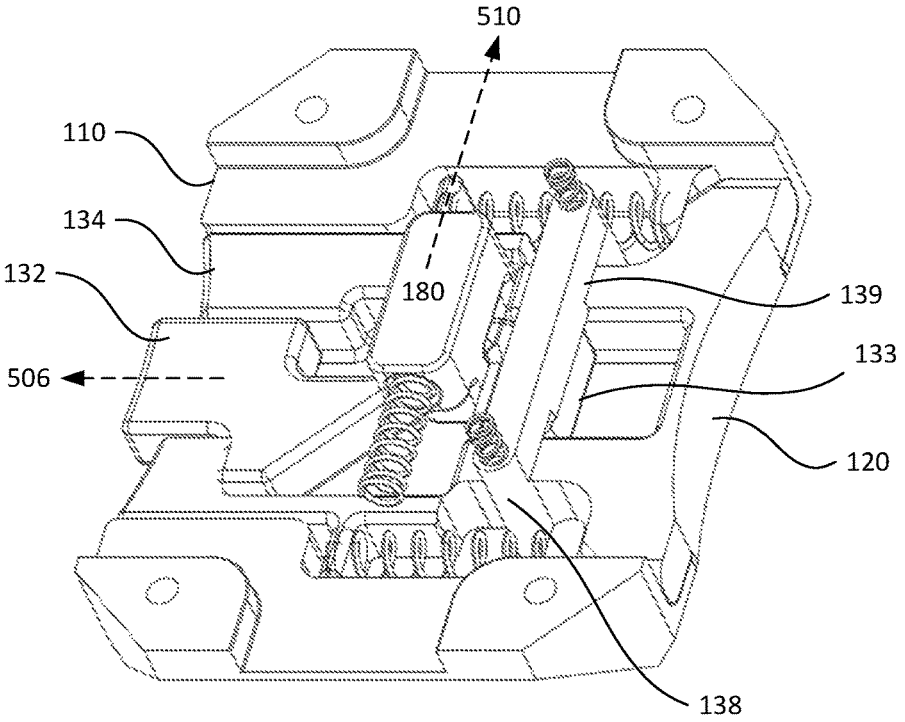

FIG. 6C depicts a configuration in which the blocking element 180 has moved in the direction 510, simultaneously moving the first actuator 132 in direction 506. The blocking element 180 is in engagement with a notched portion of the moveable element 120, locking it in place. The first actuator 132 extends beyond the second actuator 134, and is operable to unlock the locking mechanism.

Figure 6D:
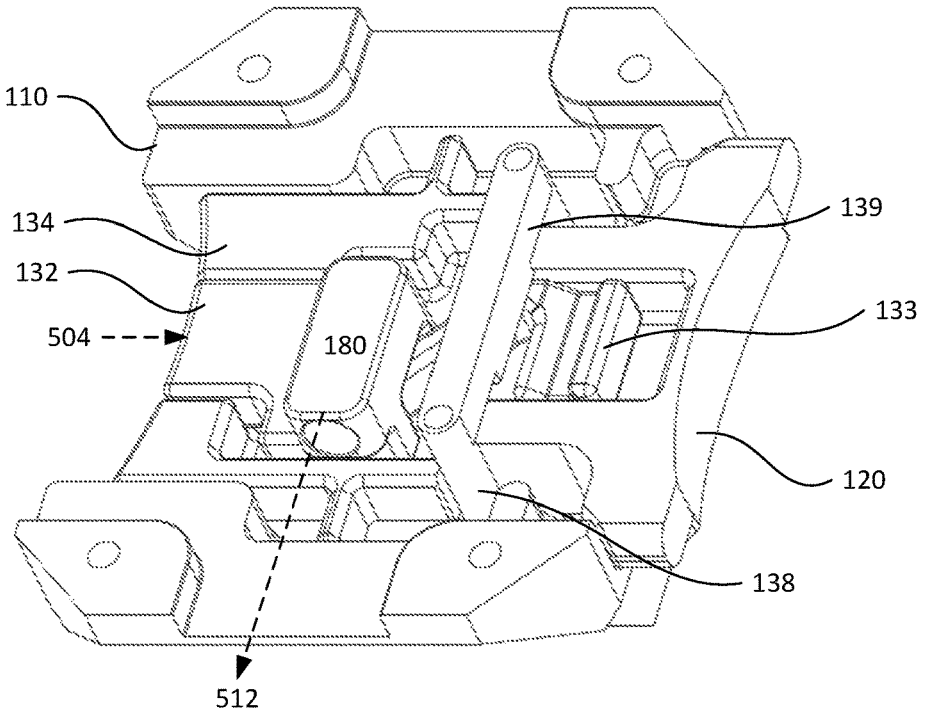

FIG. 6D depicts a configuration in which the first actuator 132, and second actuator 134, have been pressed in direction 504. This pressure moves the first actuator 132 back into the base 110, which moves the blocking element 180 in direction 512, thereby releasing the moveable element 120. Continued pressure in direction 504 moves the first actuator 132 and second actuator 134 inward of the base 110, and pushes the moveable element 120 to its extended position, allowing the rail to be removed from the rail retention device 100.

When the rail is removed, the locking pins 138 may be urged by spring bias back to their extended position, moving the blocking bar 139 back into engagement with retaining part 133. This is but one example of how such internal mechanisms may be configured. As mentioned previously, it is also possible to configure the rail retention device 100 with a "hold open" feature that may allow it to maintain a configuration substantially as shown in FIG. 6D, until another rail is inserted in the channel, and/or the device is manually returned to a closed, unlocked, position.

As will be appreciated from the foregoing examples, embodiments of the present subject matter may include at least part of the moveable element 120 moving in a "first direction," e.g. 502, toward the first engagement portion when transitioning between the open position to the closed position. The first direction may be perpendicular to a lengthwise direction of the rail section, e.g. side to side in FIGS. 1-3.

In some examples, the moveable element may be biased (e.g. by spring or other mechanism) toward the open position (rather than biased toward the closed position), such that insertion of the rail into the base element must overcome the bias, e.g. by pressure on the locking pins, and removal of the rail from the base element is assisted when the release is activated.

The rail retention device may be secured to the tactical gear mount or other holder in various ways. In some examples, a first connector (e.g. a track or other mechanical connection means) may be integrated with the tactical gear mount, and the base element may include a complimentary second connector configured to hold the base element to the tactical gear mount via the first connector.

Figure 7:
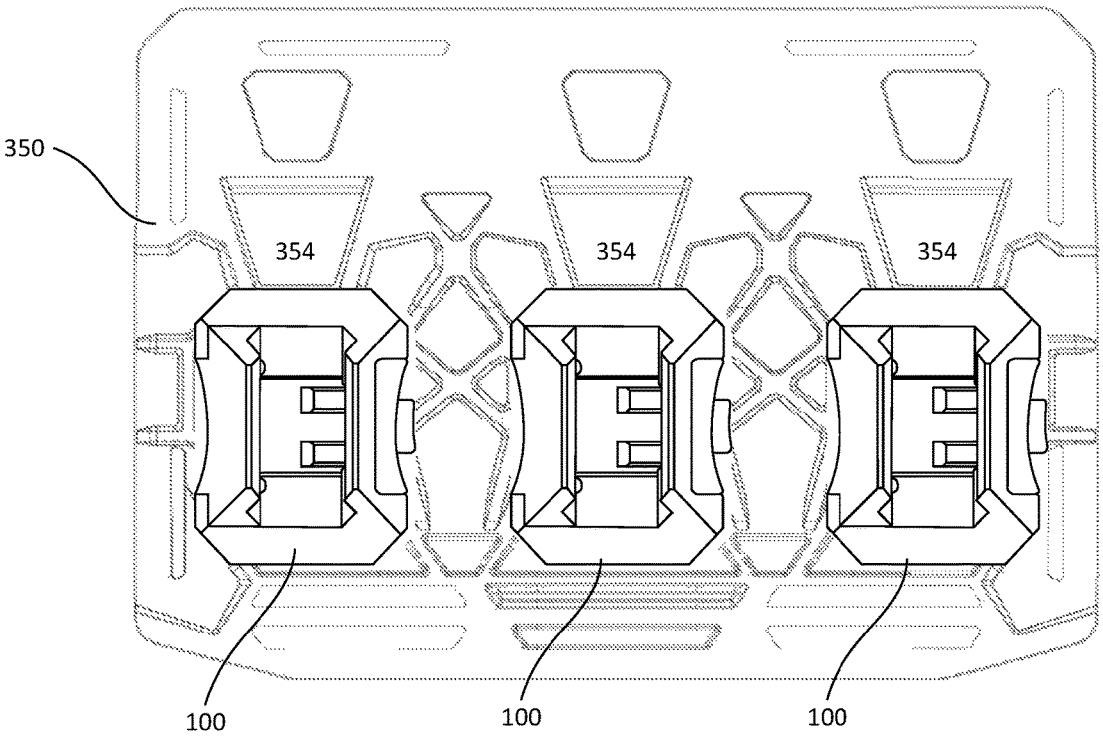
FIG. 7 is a front view of a panel including a plurality of exemplary attachment apparatus operatively attached thereto.

In some embodiments, the tactical gear mount may be at least one of a belt mount or a panel including a plurality of the first connectors. For example, FIG. 7 shows a plurality of rail retention devices 100 attached to a chest panel 350 such as described in Applicant's U.S. Patent Publication No. 2015/0327658. The chest panel 350 includes three mounting tracks with release mechanisms 354 that are similarly configured, and allow the user to personalize the specific locations and types of holders including rail retention devices 100. Similar panels (of varying sizes and shapes) can be mounted on other areas of the body providing tremendous flexibility and particularity for weapon retention and other uses. Also, in some examples, the rail retention devices 100 can be mounted in different orientations, such as two 180 degree offset orientations (for substantially rectangular tracks), or even three or more different offsets using triangular, square or other track designs.

In some examples, the female and male interface shape of the apparatus (which may, for example, be rectangular), may be modified to a dovetail, square, or other shape to accommodate generally positive fixture stability depending on shape design and customer requirements.

Figure 8:
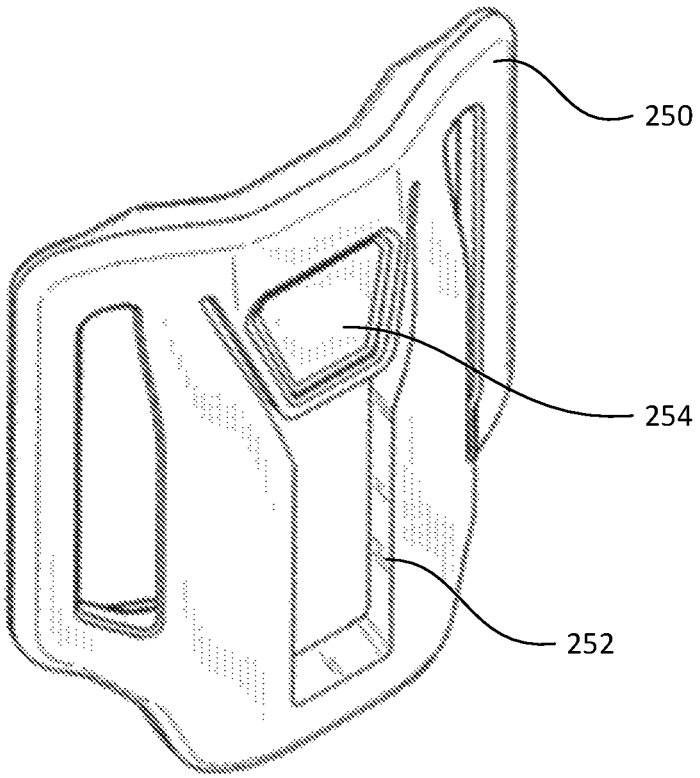
FIG. 8 (Related Art)
FIG. 8 is a side perspective view of an exemplary tactical gear mount that may be used with an attachment apparatus according to aspects of the invention.

FIG. 8 is a tactical gear belt mount 250 as shown in Applicant's U.S. Design Pat. D731,294 and shows an example of what a tactical accessory mount as described herein may be embodied as (similar to FIG. 1), in this case a belt mount. As shown in FIG. 8, tactical gear belt mount 250 includes a substantially rectangular track 252, and a deflecting element 254 that acts as a securing and quick release mechanism. In some examples, the connector 140, and grooves 142, may be configured to slide into a track like 252, and be held in a fully seated configuration by deflecting element 254. Such configurations may resist rotation of other elements, such as a base element, when attached to the accessory mount.

Figure 9:
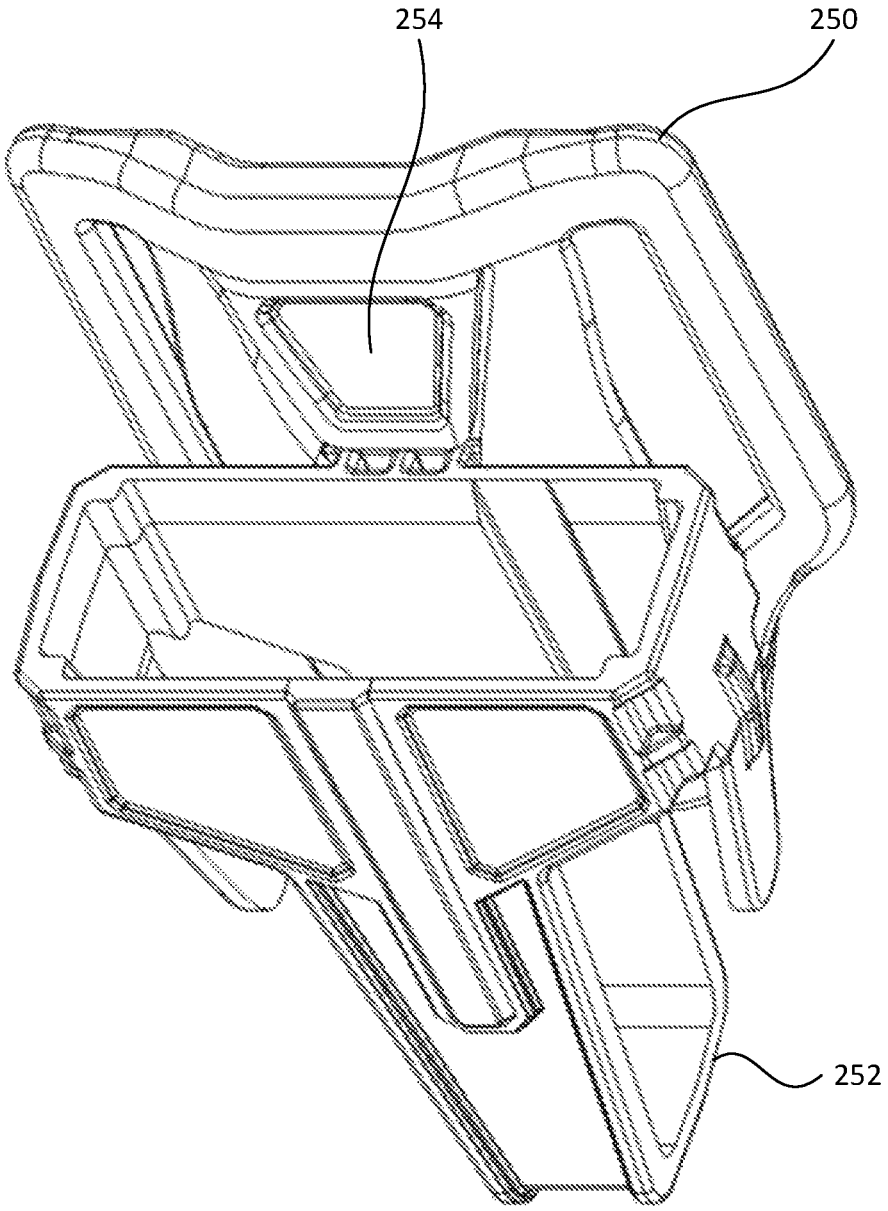
FIG. 9 (Related Art)
FIG. 9 is an isometric view of a magazine holder attached to a tactical gear mount as shown in FIG. 8.

FIG. 9 is reproduced from Applicant's U.S. Patent Publication No. 2015/0327658 and shows a magazine holder mounted to the tactical gear belt mount shown in FIG. 8. In some embodiments, a rail retention device as described herein may be mounted to a tactical accessory mount in similar fashion. Thus, the first connector and the second connector are attachable to one another using a male member of the second connector and a female member of the first connector, the male member and the second connector acting together as one monolithic unit when attaching the first connector to the second connector, the female member including a slot in the first connector, the male member insertable in and moveable in the slot to attach the first connector and the second connector to one another.

The female interface of embodiments provides a receptacle shaped to receive at least a portion of the male interface. The receptacle may be in the form of a pocket, groove, slot, notch, and/or slide, or any other type of receptacle capable of fitting a portion of the male interface therein to provide a connection between the two interfaces, and optionally further tension between the male and female interfaces may be applied using one or more magnets, spring-loaded balls, and/or plunger-type devices, or any other mechanisms known to those skilled in the art capable of connecting the interfaces to one another. In one embodiment, the female interface is designed to receive a variety of mounting plates which provide for mounting along various surfaces (e.g., MOLLE system, standard belt, wall surface, vehicle door, security locker, etc.).

In the embodiments described above, the apparatus is capable of connecting one or more accessories to one or more locations, surfaces, objects, and/or materials. The one or more accessories may for example include one or more of the following: rail, firearm (e.g., rifle or assault rifle), tool (e.g., mechanical tool), quick detach pouch. The one or more locations, surfaces, objects, and/or materials may for example include one or more of the following: mounting plate, tactical equipment, other equipment piece, belt, vehicle (e.g., a vehicle door), vest, location on a MOLLE system (e.g., of a standard military tactical nylon vest), pocket, along the waist line, wall surface, security locker. The one or more accessories may be attached to the base element, while the one or more locations, surfaces, objects, and/or materials may be attached to the tactical gear mount. The base element and tactical gear mount are then removably attachable to one another to attach the one or more weapons/accessories to the one or more locations, surfaces, objects, and/or materials via the interfaces.

A weapon or other accessory including a rail can then be attached to the rail retention device as also described herein. Other mounts are also possible, such as leg mounts, chest mounts, etc.

In embodiments, the rail retention device acts as a fastener of a firearm, tool, or other accessory to a user's belt, vehicle, tactical gear, or other object, material, or surface.

The above-described connection devices may be further secured with additional connection members, e.g., hardware such as magnetic force, spring tensioning devices, or gravity locking.

Any feature of any embodiment discussed herein may be combined with any feature of any other embodiment discussed herein in some examples of implementation.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

While the foregoing is directed to embodiments of the present invention, other and further embodiments of the invention may be devised without departing from the basic scope thereof, and the scope thereof is determined by the claims that follow.

The invention claimed is:

1. An attachment system configured to fixedly hold a rail, comprising:

a first connector integrated with a tactical accessory mount;

a base element, including a first engagement portion configured to at least partially wrap around a first edge of the rail;

a movable element configured to move relative to said base and including a second engagement portion configured to at least partially wrap around a second edge of the rail;

a locking mechanism configured to hold said movable element in a locked position with said second engagement portion holding the second edge of the rail and said first engagement portion holding the first edge of the rail; and a second connector attached to said base element and configured to hold said base element to said tactical accessory mount via said first connector, wherein, said locking mechanism is further configured to transition from an open position to the locked position via pressure applied by the rail toward said base element.

2. The system of claim 1, wherein the rail is at least one of a MIL-STD-1913 rail.

3. The system of claim 1, wherein the rail is fixedly attached to a firearm, whereby the attachment system secures the firearm to said tactical accessory mount.

4. The system of claim 1, wherein said first and second connectors are configured to engage with one another via a quick release.

5. The system of claim 1, wherein at least part of said moveable element moves in a first direction toward said first engagement portion when transitioning between the open position to the locked position.

6. The system of claim 5, wherein said locking mechanism is further configured to release the rail from the attachment apparatus via finger pressure applied substantially opposite to said first direction.

7. The system of claim 1, wherein said tactical accessory mount is at least one of a belt mount or a panel including a plurality of said first connectors.

8. The system of claim 1, wherein said first connector and said second connector are attachable to one another using a male member of said second connector and a female member of said first connector, said male member and said second connector acting together as one monolithic unit when attaching said first connector to said second connector, said female member including a slot in said first connector, said male member insertable in and moveable in said slot to attach said first connector and said second connector to one another.

9. The system of claim 8, wherein said first connector includes a flexible tooth that holds said male member in said slot, and releases said male member from said first connector via finger pressure that displaces said flexible tooth.

10. An attachment system configured to fixedly hold a rail, comprising:

a base element, including a first engagement portion configured to at least partially wrap around a first edge of the rail;

a movable element configured to move relative to said base and including a second engagement portion configured to at least partially wrap around a second edge of the rail;

a locking mechanism configured to hold said movable element in a locked position with said second engagement portion holding the second edge of the rail and said first engagement portion holding the first edge of the rail; and a mount connector attached to said base element and configured to hold said base element to a tactical accessory mount, wherein, said locking mechanism is further configured to transition from an open position to the locked position via pressure applied by the rail toward said base element, at least part of said moveable element moves in a first direction toward said first engagement portion when transitioning between the open position to the closed position, and said locking mechanism is further configured to release the rail from the attachment apparatus via finger pressure applied substantially opposite to said first direction.

11. The system of claim 10, wherein the rail is at least one of a MIL-STD-1913 rail.

12. The system of claim 10, wherein the rail is fixedly attached to a firearm, whereby the attachment system secures the firearm to the tactical accessory mount.

13. The system of claim 10, wherein said mount connector is configured to engage with the tactical accessory mount via a quick release.

14. The system of claim 10, wherein said tactical accessory mount is at least one of a belt mount or a panel including a plurality of said first connectors.

15. The system of claim 10, further comprising a first connector integrated with a tactical accessory mount.

16. The system of claim 15, wherein said first connector and said second connector are attachable to one another using a male member of said second connector and a female member of said first connector, said male member and said second connector acting together as one monolithic unit when attaching said first connector to said second connector, said female member including a slot in said first connector, said male member insertable in and moveable in said slot to attach said first connector and said second connector to one another.

17. The system of claim 16, wherein said first connector includes a flexible tooth that holds said male member in said slot, and releases said male member from said first connector via finger pressure that displaces said flexible tooth.

18. An attachment system configured to fixedly hold a rail, comprising:

a base element, including a first engagement portion configured to at least partially wrap around a first edge of the rail;

a movable element configured to move relative to said base and including a second engagement portion configured to at least partially wrap around a second edge of the rail;

a locking mechanism configured to hold said movable element in a locked position with said second engagement portion holding the second edge of the rail and said first engagement portion holding the first edge of the rail; and a release mechanism including a first pressure receiving portion that releases said locking mechanism and a second pressure receiving portion that moves said movable element to an open position in which the rail can be released from the attachment system, wherein, said locking mechanism is further configured to transition to the locked position via pressure applied by the rail toward said base element.

19. The system of claim 18, wherein said first pressure receiving portion and said second pressure receiving portion are configured to operate via a finger pressure applied in a single direction.

20. The system of claim 18, wherein said locking mechanism includes at least one locking pin that causes said locking mechanism to lock, and causes said first pressure receiving portion to move to an operating position, based on contact with the rail as the rail is seated in the attachment system.

* * * * *